United States Patent [19]

Kedward et al.

[11] 4,305,792

[45] Dec. 15, 1981

[54] PROCESSES FOR THE ELECTRODEPOSITION OF COMPOSITE COATINGS

[75] Inventors: Eric C. Kedward, Banwell; Colin A. Addison, Hutton; Francis J. Honey, Burham-on-Sea; John Foster, London, all of England

[73] Assignee: Bristol Aerojet Limited, Avon, England

[21] Appl. No.: 180,359

[22] Filed: Aug. 20, 1980

Related U.S. Application Data

[63] Continuation of Ser. No. 73,605, Sep. 10, 1979, abandoned, which is a continuation-in-part of Ser. No. 971,569, Dec. 20, 1978, abandoned.

[51] Int. Cl.[3] ..... C25D 15/00; B05D 1/16

[52] U.S. Cl. ..... 204/16; 427/180; 427/190

[58] Field of Search ..... 204/16; 427/180, 189, 427/190, 191, 196, 242

[56] References Cited

U.S. PATENT DOCUMENTS

| | | | |
|---|---|---|---|
| 3,498,890 | 3/1970 | Divecha | 204/16 |
| 3,591,466 | 7/1971 | Heiman | 204/16 |
| 3,716,461 | 2/1973 | Ahmad | 204/16 |

FOREIGN PATENT DOCUMENTS

| | | |
|---|---|---|
| 1238073 | 7/1971 | United Kingdom . |
| 1265805 | 3/1972 | United Kingdom . |

*Primary Examiner*—T. M. Tufariello

*Attorney, Agent, or Firm*—Oblon, Fisher, Spivak, McClelland & Maier

[57] ABSTRACT

A process of and apparatus for coating an article with a layer of metal incorporating particles. The article is placed in a barrel together with the particles and the barrel is placed in a plating bath and rotated therein. The barrel has an opening covered by a cover which is pervious to the solution but impervious to the particles. The article is thus flowed over by solution within the barrel which can have a high concentration of particles but there are no particles in the part of the bath outside the barrel. The process may be electroless or electrolytic. In the latter case, the anode is preferably outside the barrel.

7 Claims, 4 Drawing Figures

PROCESSES FOR THE ELECTRODEPOSITION OF COMPOSITE COATINGS

RELATED APPLICATION

This application is a continuation of applicant's copending application 073,605 filed Sept. 10, 1979 which is a continuation in part of applicants' copending application, Ser. No. 971,569, filed Dec. 20, 1978, both now abandoned.

BACKGROUND OF THE INVENTION

The present invention relates to processes and apparatus for the electrodeposition of composite coatings which consist of a metal matrix containing particles, in which processes the particles are co-deposited with the metal from a solution in which the particles are insoluble. The invention is primarily concerned with the electrodeposition of coatings incorporating ceramic particles but the particles may be of cermet or metal. Such coatings may be used for various purposes including wear and abrasion resistance, corrosion and oxidation resistance and improvement in coefficient of friction (lubricity) and anti-fretting and anti-galling properties. In certain cases the coatings themselves may constitute the final product after removal of a substrate. The process comprises electrodeposition in a bath containing insoluble particles dispersed in the bath, the particles being co-deposited with the metal deposited from the bath. The process and apparatus of the invention may be used for electroless deposition but are particularly applicable to electrolytic deposition.

PRIOR ART

In British Pat. No. 860,291 it is proposed to remove electrolyte containing particles from the bottom of the bath and to reintroduce this electrolyte to the top of the bath so that the particles fall through the bath under gravity; the article which is being coated and which forms the cathode is rotated about a generally horizontal axis so that the falling particles settle on the parts of the article which are uppermost for the time being. It has been found that this system does not provide an even coating, particularly on parts which are of irregular shape. British Pat. No. 1,218,179 describes a process in which the article is suspended without movement in a bath and the particles are maintained in suspension in the bath by circulating the solution, gas being admitted to the container to produce a generally upward flow of solution and gas in the vicinity of the surface on which deposition is occurring. Another construction is described in British Pat. No. 1,329,081 in which the solution is agitated by movement generally up and down of a generally horizontal perforated agitator in the solution below the part being coated. Both these arrangements have proved extremely satisfactory in use but both require large volumes of solution and particles, and this is expensive. In addition, considerable energy is required to maintain the large volume of the bath homogeneous.

SUMMARY OF THE INVENTION

According to the present invention, a process of coating an article with a layer of metal incorporating particles comprises placing said article and particles within a hollow barrel, immersing said barrel in a plating solution, at least part of the wall of said barrel being impervious to said particles but pervious to said solution, rotating said barrel at a speed not greater than four revolutions per minute about a horizontal axis or an axis which is slightly inclined to the horizontal, and codepositing metal and particles on to the article.

The actions which occur within the barrel are quite different from those occurring in the plating operations referred to above. In the case of British Pat. No. 860,291, both electrolyte and particles are removed from the bottom of the bath and are reintroduced to the top so that there is a flow downwardly through the bath of both electrolyte and particles, the particles being relatively widely dispersed in the electrolyte. In the case of British Pat. Nos. 1,218,179 and 1,329,081 there is no predominant downward flow and the particles are maintained in suspension around the workpiece being plated. In all these systems, an increase in the proportion of particles in the bath leads to an increase in the proportion of particles in the plated coating only up to a certain limit which is fairly low, typically about 400 grams per liter.

With the barrel of the present invention rotating at the low speeds envisaged by the invention and the very high particle concentrations which have been found to be effective, the particles are not dispersed through the solution in the way that they are with the other systems discussed but form a fairly thick slurry a layer of which is carried up on the inside surface of the barrel by the rotation of the barrel and, when it reaches a certain height falls away from the inside surface of the barrel, drops towards the bottom of the barrel and falls onto the workpiece on which it forms a thick layer. This layer slides slowly off the workpiece as more slurry is deposited on it so that the surface of the workpiece is washed over by a slow-moving fairly dense layer of slurry comprising particles and electrolyte. This density of particles is achieved without a very large inventory of particles because the particles are present only in a part of the bath which is sectioned off from the remainder, namely the interior of the barrel. The achievement of a small inventory of particles is particularly advantageous where valuable particles such as diamond are employed. Moreover, it has surprisingly been found that the limit on the proportion of particle inclusion in the plated coating which has been encountered in the prior processes referred to can be substantially exceeded by the system of the invention. Thus whereas before little improvement was found using a particle concentration in the electrolyte above about 400 grams per liter, useful results have been obtained with the present invention using concentrations as high as 3000 grams per liter.

It has been suggested in U.S. Pat. No. 3,498,890 issued Mar. 3, 1970 to A. P. Divecha et. al. that composites containing whiskers can be produced using a porous ceramic pot which is located in the electrolyte bath and which contains the whiskers. The workpiece is rotated about a vertical axis or agitation may be employed but in neither case is there any effect equivalent to the gentle washing of the workpiece by a dense slurry which falls slowly downwards due to the slow rotation of the barrel in the system of the present invention.

Barrels rotating about horizontal axes are of course well known—see, for example, British Patent Specifications Nos. 1,415,107, 1,275,246, 1,238,073 and 1,177,414—but these are for use in different fields and operate in different ways and produce different results from the present invention.

By use of the invention, it is possible to cause a stream of solution heavily loaded with particles to flow gently over the surface to be plated without stagnation occurring. The heavy loading is achieved in a restricted area, i.e. within the barrel, while there is a larger volume of solution whose characteristics, e.g. temperature, concentration and homogeneity, can more easily be maintained constant than could the smaller volume. The space outside the barrel can be utilised for such items as heaters, agitators and, in the case of electrolytic plating, anodes which in the previous processes have been located in the solution containing particles.

To improve circulation of the particles, it is preferred for the barrel to contain paddles rotating therewith, the paddles being formed by axially extending ribs on the interior surface of the barrel. In most cases the article to be plated will be rigidly supported within and from the barrel, but advantages may be obtained in certain cases by supporting the article separately from the barrel so that the article is held stationary or rotates about the axis of rotation of the barrel or another axis at a speed which is different from the speed of rotation of the barrel. In an alternative arrangement the interior surface of the barrel is conductive and is connected into the plating circuit and the part or parts to be plated are loose within the barrel so that they tumble as the barrel rotates.

Where the process is used for electroless plating, the solution will be of appropriate composition, for example a nickel-phosphous electroless plating solution with diamond particles in the barrel. Where the process is used for electrolytic plating, the solution will be of appropriate composition, for example a cobalt plating solution with chromium carbide particles in the barrel, and the process will include passing an electric current between an anode in the solution and the article.

EMBODIMENTS

Figure 4:
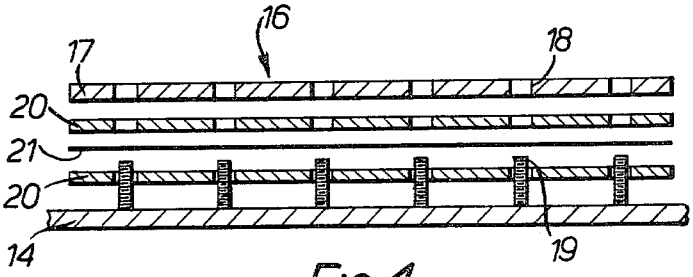
FIG. 4 is an exploded view of one composite closure panel for the barrel.

The apparatus shown in the drawings comprises a tank 1 to contain a bath of electrolyte 2. A framework 3 having uprights 4 and a horizontal 5 extends over the bath to support by means of S-hooks 6 a frame 7 which depends into the bath 2 and carries bearings 8 in which trunnions 9 and 10 rotate. The trunnions are attached to the opposite end walls 11, 12 of a hexagonal hollow barrel 13 comprising six walls 14 each of which contains a rectangular aperture 15 closed by a composite cover 16 the construction of which is shown in more detail in FIG. 4. Each cover comprises a rectangular frame member 17 having a plurality of holes 18 through which studs 19 attached to the respective wall 14 of the barrel 13 can pass. The frame traps between itself and the wall 14 a sandwich constituted by two outer layers 20 of porous neoprene and an inner layer 21 formed by filter paper. The neoprene layers, which are 3 millimeters thick, have a nominal pore size of 10 micrometers (μm) while the filter paper has a nominal pore size of 2 μm.

The barrel can be rotated by means of an electric motor 22 supported by the upper horizontal of the frame 7 and connected to the trunnion 10 by a gear wheel 23 on the motor output shaft, an idler wheel 24 mounted on an upright of the frame 7, and a gear wheel 25 mounted on the trunnion 10. The barrel contains paddles 30.

Figure 1:
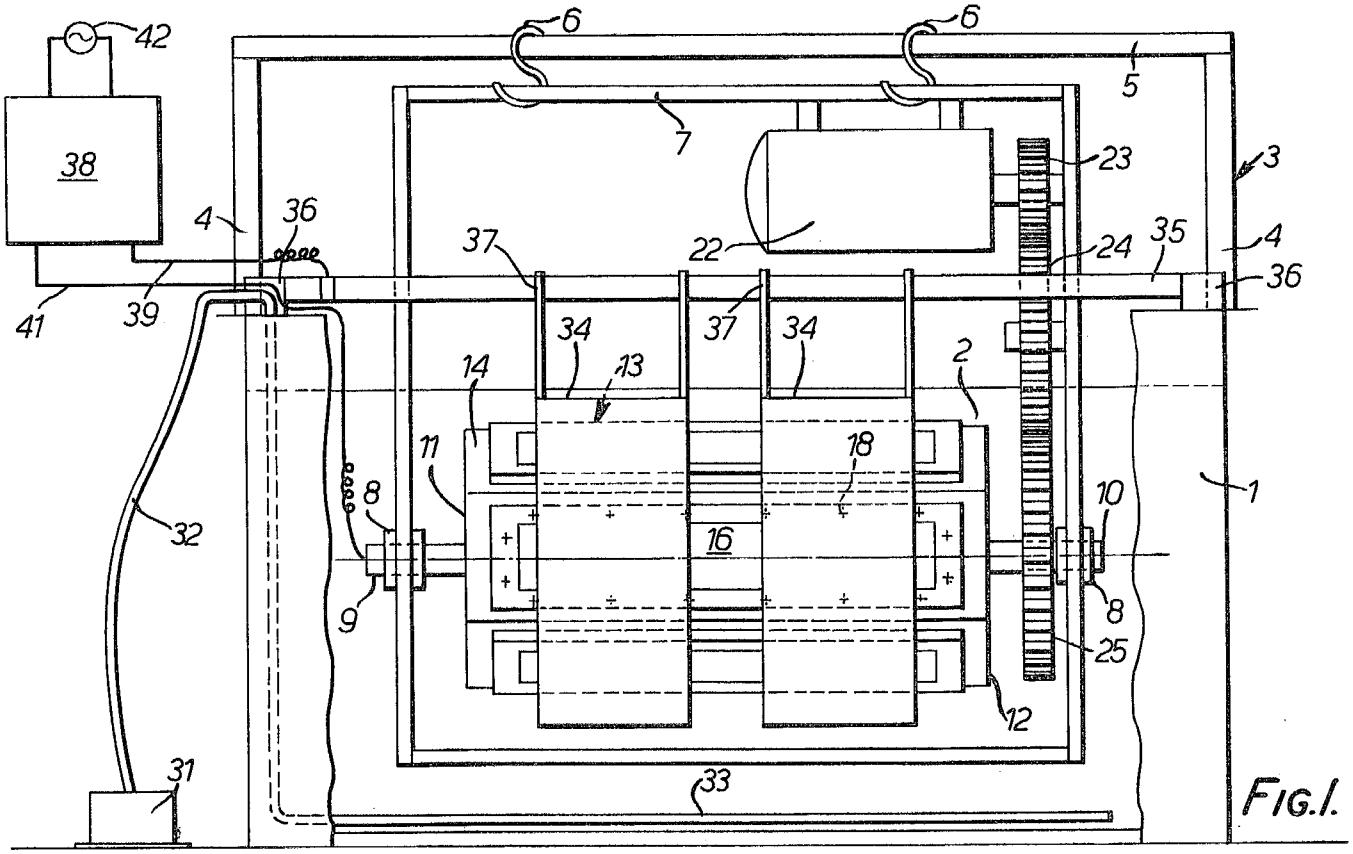
FIG. 1 is a somewhat diagrammatic side elevation of apparatus for performing a process of electrodeposition of composite coatings, part of the tank wall being broken away to show the apparatus within.
Figure 2:
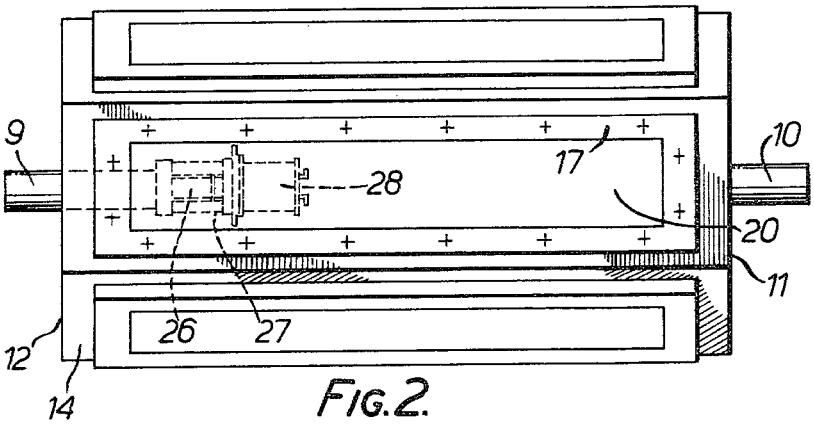
FIG. 2 is a side elevation of the drum of the apparatus shown in FIG. 1 to a slightly enlarged scale.
Figure 3:
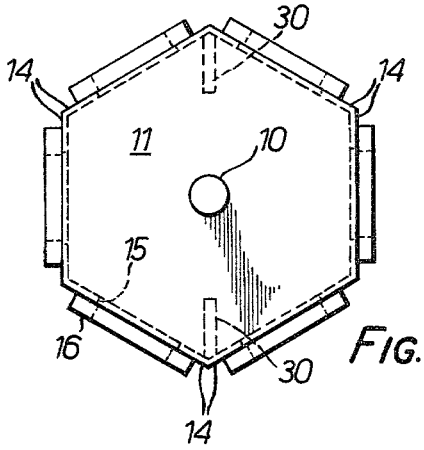
FIG. 3 is an end elevation of the drum shown in FIG. 2.

As can be seen in FIG. 2, the inner end of the trunnion 9 extends axially into the barrel and terminates in a threaded spigot 26 on which can be screwed a mounting jig 27 carrying a part 28 to be coated, in this case a turbine stator blade having platforms at each end.

The apparatus includes an air blower 31 connected by a flexible pipe 32 to a horizontal outlet pipe 33 in the base of the tank 1, the outlet pipe 33 having a number of apertures in its upper surface so that when the blower 31 is in operation air can be bubbled into the solution.

EXAMPLE 1

Using the apparatus described, a stainless steel panel two inches by one inch by one-eighth of an inch was provided with a composite coating comprising a cobalt matrix including particles of chromium carbide. The tank was filled with a solution comprising 450 grams per liter of cobalt sulfate, 30 grams per liter of boric acid and 12.5 grams per liter of sodium chloride. To 125 liters of this solution contained in the tank was added 10 milliliters of Canning's anti-pit liquid and there was supported in the bath four anodes 34 comprising cobalt chips contained in titanium baskets surrounded by anode bags.

The panel to be coated was given a pretreatment comprising immersion in a cyanide cleaner for two minutes followed by a water rinse, etching by immersion for 30 seconds in 50% sulfuric acid followed by a water rinse, and a nickel strike by plating in a nickel bath for three minutes at a current density of 3.9 amps per square decimeter. The panel was secured in the plating barrel in the manner described for the stator blade 28 shown in FIG. 2 and the panel was connected to a cathode contact. Sufficient chromium carbide powder with a mean particle size of 2 to 5 μm was added to the barrel in an amount to provide 2500 grams per liter of barrel capacity and the opening in the barrel through which the panel to be coated and the powder were admitted was closed by the attachment of a cover 16. The barrel was then completely submerged in the solution in the tank and was rotated at three revolutions per minute while composite plating took place at a voltage of between 2.5 and 3 volts with a current density of approximately 2.7 amps per square decimeter. The solution temperature was maintained at 50° C. and the solution had a pH of between 4.5 and 5. After plating had proceeded for a time sufficient to give a thickness of plating of 0.05 mm, plating was stopped and the panel was examined. It was found that the panel has been given a tenacious coating having an even distribution of particles with a particle content of approximately 28.9% by weight and 35.2% by volume. The barrel capacity was 6 liters.

A series of experiments using the process and apparatus described in the aforementioned British Pat. No. 1,218,179 but otherwise using the conditions of the Example set out above and with a progressively increasing loading of particles has indicated that the proportion of particles in the coating increases little, if at all, as the loading rises above 400 grams per liter at which level the proportion was found to be about 23%. A series of experiments using the apparatus shown in FIGS. 1 to 4 and following the procedure set out in the Example above produced the following results:

| Bath loading | Particle Inclusion (Weight %) |
|---|---|
| 400 | 17 |
| 500 | 20 |
| 600 | 22.6 |
| 700 | 23.1 |
| 1000 | 24.9 |
| 1500 | 26.5 |
| 2500 | 28.9 |
| 3000 | 33.2 |

It will be seen that the limit which occurs with the process described in British Pat. No. 1,218,179 does not occur with the process described in the present invention.

EXAMPLE II

The apparatus described was used for electrolessly plating a stainless steel panel two inches (50.8 mm) by one inch (25.4 mm) by one-eighth of an inch (3.2 mm) thick with a composite coating comprising a nickel-phosphorous matrix including diamond particles. The tank was filled with a proprietary electroless nickel-phosphorous plating solution known as Niklad-794 and sold by Lea Manufacturing Limited of Buxton, Derbyshire, England. The bath was made up of equal parts of 794A diluted to 80 milliliters/liter and 794B diluted to 150 ml/l.

The panel to be coated was given the same pretreatment as in example 1 and secured in the barrel in the same way. Sufficient diamond powder was added to the barrel to provide 35 gms/l of barrel capacity, that is more than four times the nickel content of the same quantity of solution. The barrel was then closed and completely submerged in the solution in the tank and was rotated at three revolutions per minute. To initiate the electroless deposition, a voltage of 2 volts was established between the article and the anodes for between five and ten seconds and was then switched off. Electroless deposition was allowed to continue for one hour. It was found that the panel then carried a homogeous and tenacious deposit 20 micrometers thick and containing between 20 and 25 percent by volume of diamond powder in a nickel-phosphorous matrix. This may be compared with between 15 and 20 percent by volume of diamond powder contained in deposits using similar conditions but using the process and apparatus described in the aforementioned British Pat. No. 1,218,179.

What we claim as our invention and desire to secure by Letters Patent is:

1. A process of coating an article with a layer of metal incorporating particles, the process comprising placing said particles within a hollow barrel supporting said article therein, immersing said barrel in a plating solution whereby said particles form a slurry at the bottom of said barrel, at least part of the wall of said barrel being impervious to said particles but pervious to said solution, rotating said barrel at a speed not greater than four revolutions per minute about a substantially horizontal axis, and codepositing metal and particles onto the article, whereby said codepositing is provided by said slurry being carried up on the interior of said barrel by said rotation, falling onto said article as a dense layer and sliding off said article.

2. A process according to claim 1 wherein said plating solution is an electrolytic plating solution and the process includes passing an electric current between an anode in said solution outside said barrel and said article.

3. A process according to claim 1 wherein circulation of the particles is aided by paddles contained in the barrel and rotating therewith.

4. A process according to claim 1 wherein said barrel is rotated at a speed not greater than two revolutions per minute.

5. A process according to claim 1 wherein said particles are chromium carbide particles and said solution is a cobalt plating solution.

6. A process according to claim 1 wherein said particles are present in an amount of at least about 1000 grams per liter of barrel capacity.

7. A process of electroplating an article with a layer of cobalt incorporating chromium carbide particles, the process comprising: supporting said article in a hollow barrel having internal paddles; placing in said barrel chromium carbide particles in an amount of at least 2 kilograms per liter of capacity of said barrel; immersing said barrel in a cobalt plating solution whereby said particles form a slurry at the bottom of said barrel, at least part of the wall of said barrel being impervious to said particles but pervious to said solution; providing a cobalt anode in said solution outside said barrel; rotating said barrel about a substantially horizontal axis at a speed not greater than two revolutions per minute; and passing an electric current between said article and said anode, whereby said electroplating is provided by said slurry being carried up on the interior of said barrel by said rotation, falling onto said article as a dense layer and sliding off said article.

* * * * *

UNITED STATES PATENT AND TRADEMARK OFFICE

CERTIFICATE OF CORRECTION

PATENT NO. : 4,305,792

DATED : Dec. 15, 1981

INVENTOR(S) : Eric C. Kedward, et. al.

It is certified that error appears in the above—identified patent and that said Letters Patent is hereby corrected as shown below:

The Priority Data, which was omitted should read as follows.

[30]---Foreign Application Priority Data

| | | |
|---|---|---|
| Dec. 20, 1978 | Germany..... | 2855054 |
| Dec. 21, 1977 [GB] | United Kingdom.... | 53325/77 |

Signed and Sealed this

First Day of June 1982

[SEAL]

Attest:

GERALD J. MOSSINGHOFF

Attesting Officer

Commissioner of Patents and Trademarks